US005808405A

United States Patent [19]

Koh

[11] Patent Number: 5,808,405

[45] Date of Patent: Sep. 15, 1998

[54] ELASTIC NON-WELDED SHADOW MASK SUPPORT ASSEMBLY FOR COLOR CATHODE-RAY TUBE

[75] Inventor: Bongsoo Koh, Kyungsangnam-do, Rep. of Korea

[73] Assignee: Samsung Display Devices Co., Ltd., Kyungki-do, Rep. of Korea

[21] Appl. No.: 688,996

[22] Filed: Aug. 1, 1996

[30] Foreign Application Priority Data

Oct. 12, 1995 [KR] Rep. of Korea ..... 1995-28576 U

[51] Int. Cl.[6] ..... H01J 9/18; H01J 39/07

[52] U.S. Cl. ..... 313/402; 313/404; 313/407

[58] Field of Search ..... 313/402, 404, 313/406, 407, 408

[56] References Cited

U.S. PATENT DOCUMENTS 3,309,493 3/1967 Vitale ..... 313/402

3,521,104 7/1970 Mears ..... 313/407

*Primary Examiner*—Sandra L. O'Shea

*Assistant Examiner*—Joseph Williams

*Attorney, Agent, or Firm*—Christie, Parker & Hale, LLP

[57] ABSTRACT

A shadow mask support assembly for a color cathode-ray tube prevents partial thermal deformation generated by welding a shadow mask and a mask frame. Also, the shadow mask support assembly for a color cathode-ray tube includes a mask frame suspended and supported in the inner face of the panel, a shadow mask inserted in the inner circumference of the mask frame, and an elastic band for supporting the inner circumference of the mask frame body which presses a skirt portion of the shadow mask from its outer circumference to prevent welding the mask frame and the shadow mask.

3 Claims, 3 Drawing Sheets

ELASTIC NON-WELDED SHADOW MASK SUPPORT ASSEMBLY FOR COLOR CATHODE-RAY TUBE

BACKGROUND OF THE INVENTION

The present invention relates to a shadow mask support assembly for a color cathode-ray tube which supports a mask frame and a shadow mask having a circle shape without welding them together.

In general, the color cathode-ray tube includes a bulb which constitutes a panel, a funnel, and a neck. The panel is formed with a screen which includes phosphors of the three primary colors R, G and B. The funnel includes deflection means which are disposed at an opened side and a neck all of which are combined with one body, and the inner face of the panel is formed with a screen which includes phosphors of the three primary colors R, G and B. Also, a shadow mask having a color-sorting function is disposed in a fixed distance from the screen and it is set up with the panel.

The shadow mask is disposed in the inner face of the skirt portion so as to land electron beams emitted from an electron gun on the phosphors respectively.

The shadow mask is welded on a mask frame hung to a stud pin which partially fills the skirt portion of the inner face of the panel.

In general, the screen of the color cathode-ray tube is rectangle-shaped, however the screen portion may be round for special usages.

However, because the color cathode-ray tube having the above structure is formed by welding the shadow mask and the mask frame, the partial thermal deformation of the welded portion causes the apertures of the shadow mask to be placed away from the path of the electron beams.

This causes color purity deterioration when displaying.

This is particularly true when the color cathode-ray tube, the mask frame and the shadow mask are circle shaped. Therefore, the shadow mask is partially welded along the circumference of the mask frame, and, consequently, a curvature of the shadow mask is changed.

SUMMARY OF THE INVENTION

It is an objective of the present invention to provide a shadow mask support assembly for color cathode-ray tubes which can prevent color purity deterioration resulting from the thermal deformation. In addition, The invention provides the shadow mask support assembly for a color cathode-ray tube suspending a shadow mask without welding the shadow mask and a mask frame.

To realize above and additional objectives, the invention provides the shadow mask support assembly for a color cathode-ray tube including a mask frame suspended and supported on an inner face of the panel, a shadow mask inserted in the inner circumference of the mask frame, and an elastic band for supporting the inner circumference of the mask frame body which presses a skirt portion of the shadow mask toward its outer circumference.

The end portion of the elastic band is thinner than the rest of its areas.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION

A preferred embodiment of the present invention will now be described in detail with reference to the accompanying drawings.

Figure 1:
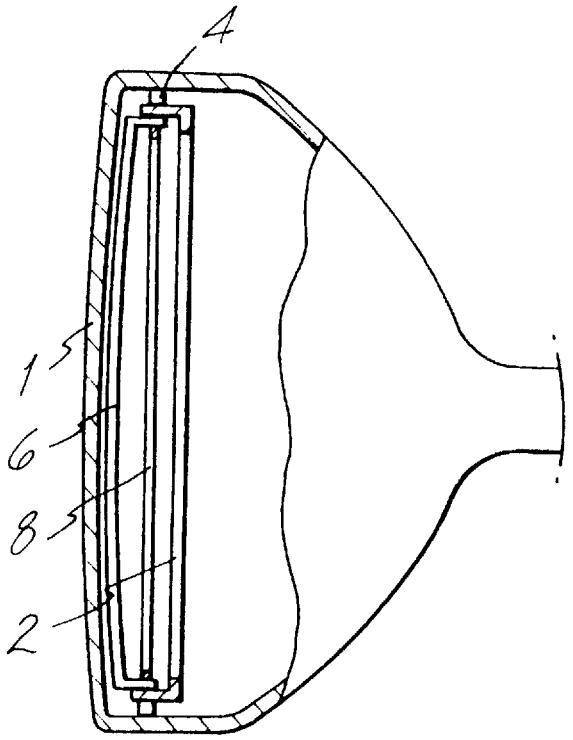
FIG. 1 is a partial side sectional view showing a cathode-ray tube where a shadow mask support assembly in accordance with a preferred embodiment of the present invention is applied.
Figure 2:
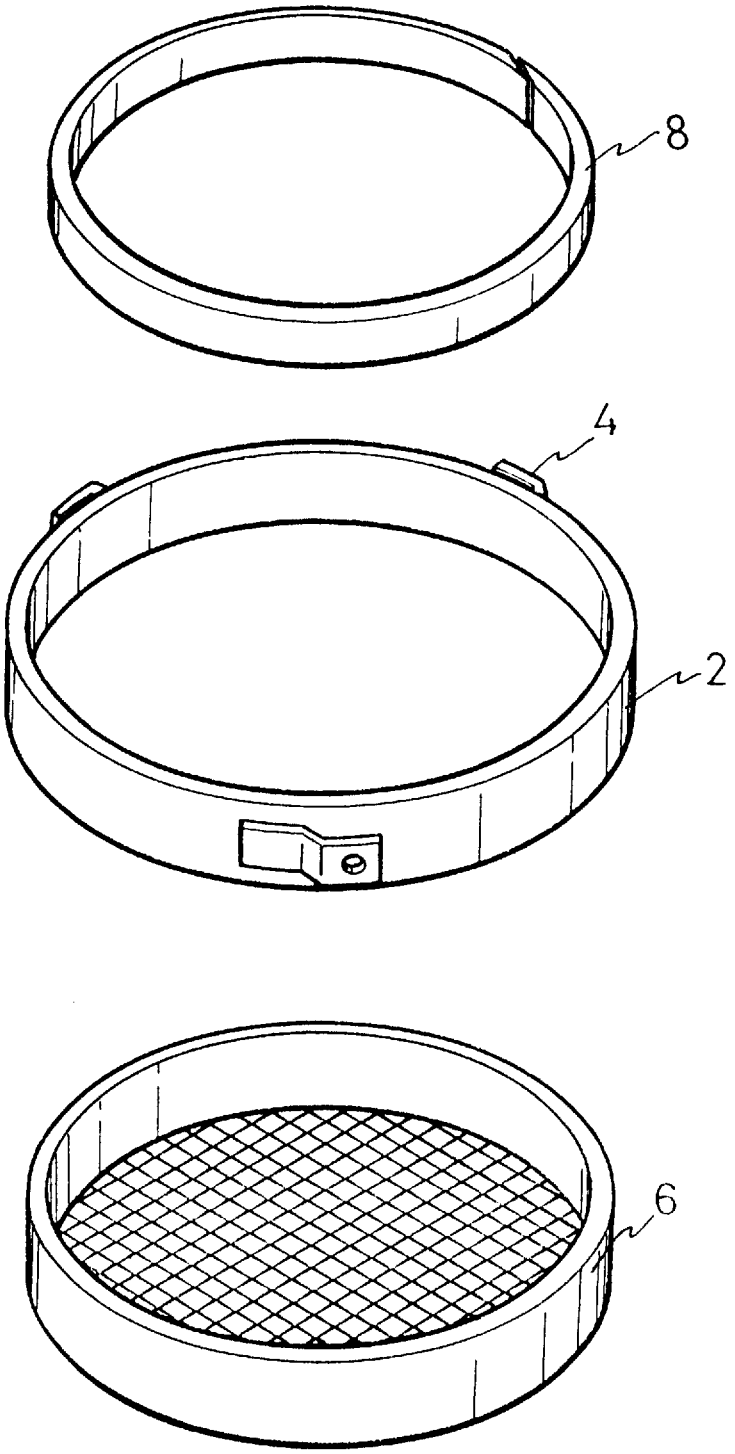
FIG. 2 is an exploded perspective view showing a shadow mask support assembly in accordance with a preferred embodiment of the present invention.
Figure 3:
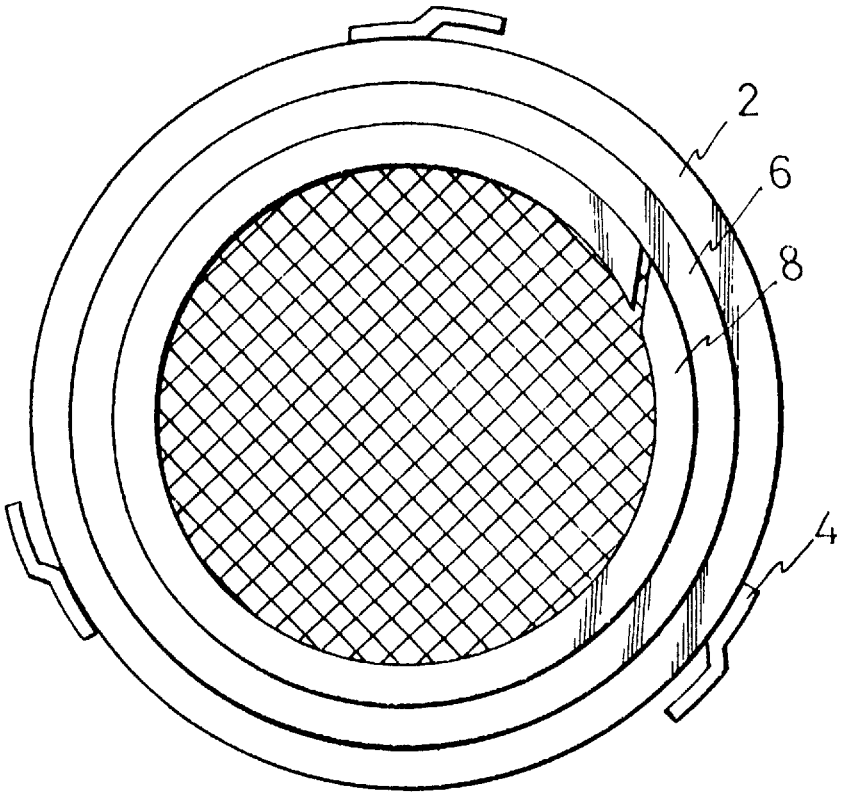
FIG. 3 is a plane view showing a shadow mask support assembly in accordance with a preferred embodiment of the present invention.

Referring to FIGS. 1 to 3, there is a partially-illustrated disassembly of a shadow mask support assembly and a mask frame 2 that have a regular thickness and a circular band shape.

A multiple bimetal spring 4 is fixed with a stud pin (not shown) on the outer circumference of the mask frame 2 for installation onto the inner face of a front panel 1 of the cathode-ray-tube.

A shadow mask 6, which is round, has its outer circumference corresponding to an inner circumference of the mask frame 2, enabling the shadow mask to insert in the inner face of the mask frame 2.

The portion of the shadow mask 6 contacted to the mask frame 2 is made of a portion without apertures that electron beams are not passed through.

The invention provides an elastic band 8 by means for attaching the mask frame 2 and the shadow mask 8.

The elastic band 8 is manufactured from a metal having a strip band shape and is elastic. This elasticity is such that it applies pressure toward the circumference of a circle, in other words, toward the outside.

When the elastic band 8 contacts the inner circumference of the shadow mask 6, there is no crack between the elastic band 8 and the inner circumference of the shadow mask 6 because both end portions of the elastic band 8 are thinner than the other areas.

In addition, the outer circumference of the elastic band 8 is bigger than the inner circumference of the mask frame 2 when not pressing the elastic band. Therefore, the elastic band is pressed toward its circumference when inserting the elastic band 8 in the inner face of the shadow mask 6.

The shadow mask support assembly made in this manner, after inserting the shadow mask 6 in the inner circumference of the mask frame 2, the elastic band 8 is inserted in the inner circumference of the shadow mask 6.

After squeezing the elastic band 8 and inserting in the inner circumference of the shadow mask 6 so that its outer circumference is reduced, the elastic band 8 is expanded toward its circumference and presses the shadow mask 6 toward the inner circumference of the mask frame 2.

The shadow mask 6 is thus solidly supported in the mask frame 2 because of the pressure of the elastic band 8.

The above shadow mask support assembly prevents the partial thermal deformation of the shadow mask resulting from welding because it can support the shadow mask without welding.

Tension is applied to the surface of the shadow mask and it remains flat because of the elasticity applied to the shadow mask toward its circumference.

Accordingly, when the cathode-ray tube is operated, the invention can prevent doming phenomena generated by thermal deformation of the shadow mask and improve color purity.

While this invention has been described in connection with what is presently considered to be the most practical and preferred embodiments, it is to be understood that the invention is not limited to the disclosed embodiment, but, on the contrary, it is intended to cover various modifications and equivalent arrangements included within the spirit and scope of the appended claims.

What is claimed is:

1. A shadow mask support assembly for a color cathode-ray tube comprising:

a mask frame having an inner circumference;

a shadow mask inserted against the inner circumference of the mask frame, said shadow mask having a skirt portion with an inner circumference; and an elastic band pressing against the inner circumference of the skirt portion of the shadow mask to support the shadow mask against the inner circumference of the mask frame.

2. The shadow mask support assembly for a color cathode-ray tube according to claim 1 wherein the elastic band comprises a middle portion and two end portions, both of the end portions of the elastic band being thinner than the middle portion.

3. A color cathode-ray tube, comprising:

a front panel having an inner face; and a shadow mask support assembly comprising:

a mask frame suspended and supported from the inner face of the front panel, said mask frame having an inner circumference, a shadow mask inserted against the inner circumference of the mask frame, said shadow mask having a skirt portion with an inner circumference, and an elastic band pressing against the inner circumference of the skirt portion of the shadow mask to support the shadow mask against the inner circumference of the mask frame.

* * * * *